United States Patent [19]

Hammill

[11] 4,364,623

[45] Dec. 21, 1982

[54] SOLDERLESS UNIVERSAL OUTLET

[75] Inventor: S. Scott Hammill, Mount Laurel, N.J.

[73] Assignee: SGL Industries, Inc., Haddonfield, N.J.

[21] Appl. No.: 190,050

[22] Filed: Sep. 23, 1980

[51] Int. Cl.[3] ..... H01R 13/11; H01R 13/506; H01R 21/06

[52] U.S. Cl. ..... 339/126 RS; 29/854; 339/175 R; 339/192 R

[58] Field of Search ..... 339/20, 21 R, 22 R, 339/22 B, 23, 59 R, 61 R, 175 R, 175 C, 191 R, 191 M, 192 R, 126 R, 126 RS; 29/854

[56] References Cited

U.S. PATENT DOCUMENTS

| | | | |
|---|---|---|---|
| D. 208,551 | 9/1967 | Geis, Jr. | D13/24 |
| 2,108,031 | 2/1938 | Acuff | 339/21 R |
| 2,234,745 | 3/1941 | Von Rarrel | 339/21 R |
| 2,464,964 | 3/1949 | Charap | 339/21 R |
| 2,743,423 | 4/1956 | Parks | 339/21 |
| 3,044,035 | 7/1962 | Adams, Jr. | 339/21 R |
| 3,081,442 | 3/1963 | Platz | 339/14 |
| 3,089,042 | 5/1963 | Hichey et al. | 307/147 |
| 3,116,960 | 1/1964 | Olsson et al. | 339/128 |
| 3,253,137 | 5/1966 | Richter | 339/96 |
| 3,714,618 | 1/1973 | Appleton | 339/198 R |
| 3,715,457 | 2/1973 | Teagno et al. | 174/88 R |
| 3,778,748 | 12/1973 | Holman | 339/64 M |
| 4,113,334 | 9/1978 | Instone | 339/22 R |

FOREIGN PATENT DOCUMENTS

| | | | |
|---|---|---|---|
| 1121755 | 8/1956 | France | 339/175 R |
| 1066240 | 4/1967 | United Kingdom . | |
| 2033678 | 5/1980 | United Kingdom . | |

OTHER PUBLICATIONS

IBM Bulletin, Evans, vol. 10, No. 10, p. 1521, 3-1968.

*Primary Examiner*—Neil Abrams
*Attorney, Agent, or Firm*—Cushman, Darby & Cushman

[57] ABSTRACT

An electrical receptacle is provided that does not require any soldered connections for the hot and neutral conductor wires, and in fact does not even require crimping. A receptacle body of electrical insulating material is formed in two parts with a pair of elongated prong-receiving slots in the body. A pair of conductor wires, each having a bare uninsulated portion, are each disposed in a groove intersecting each of the slots with the bare portion of the wire at the intersection between the slot and groove. The receptacle body parts are then moved into holding relationship with each other, with a portion of the body biasing the bare portions of the wires into intersecting relationship with the slots. The outlet assembly is held tightly to varying thicknesses of mounting surfaces through the action of a molded plastic spring(s). A ground conductor of similar or conventional design may be provided.

11 Claims, 8 Drawing Figures

Fig. 1
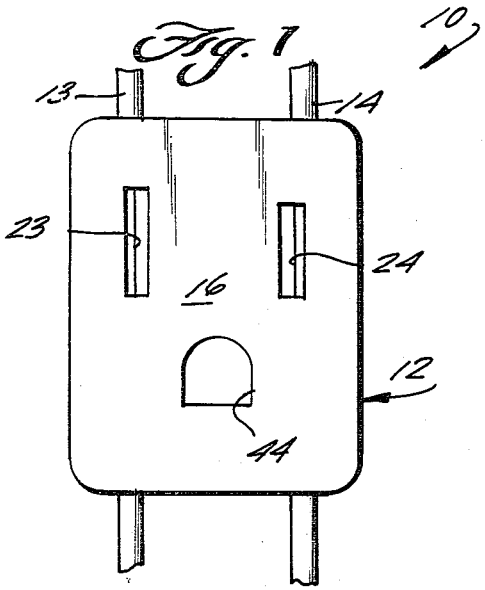
Fig. 2
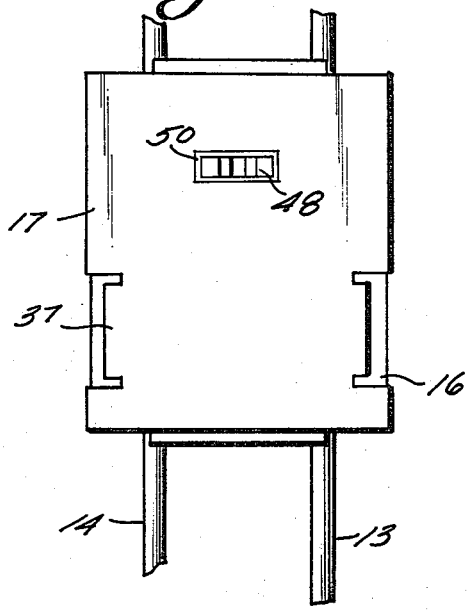
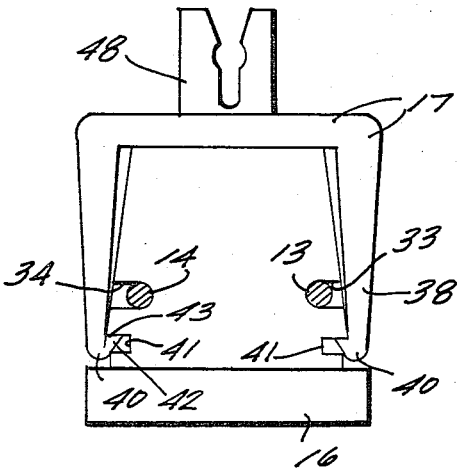
Fig. 3
Fig. 4
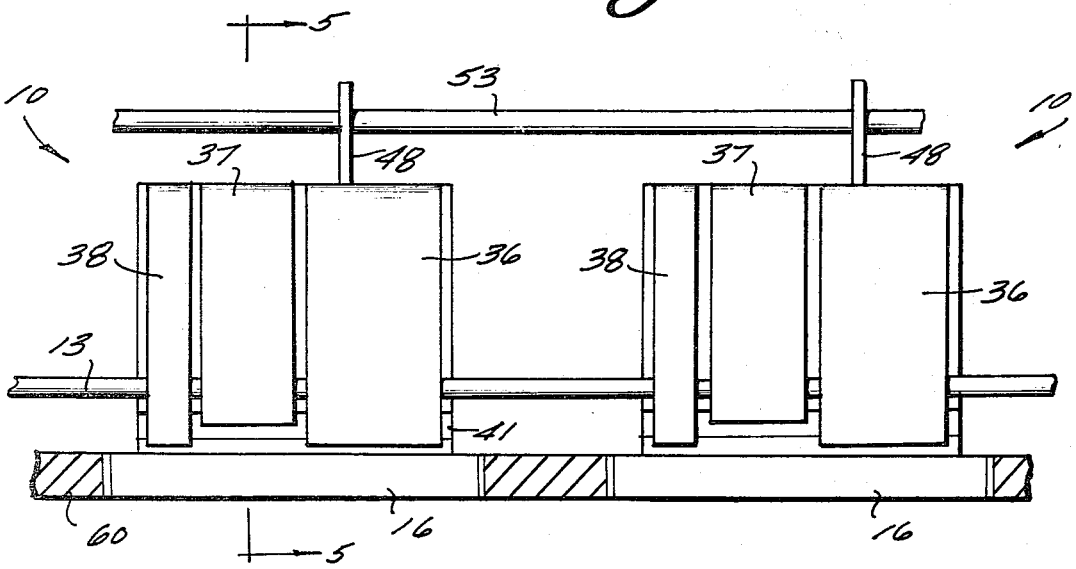

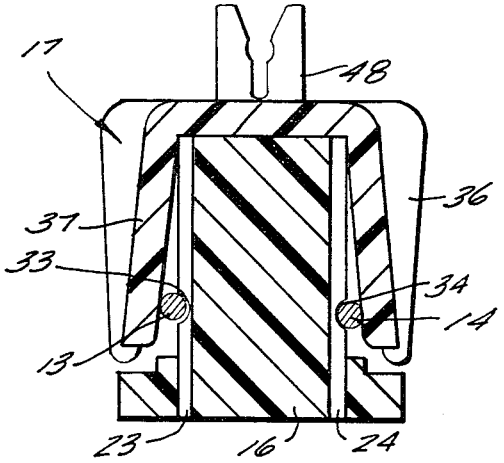
Fig. 5
Fig. 6
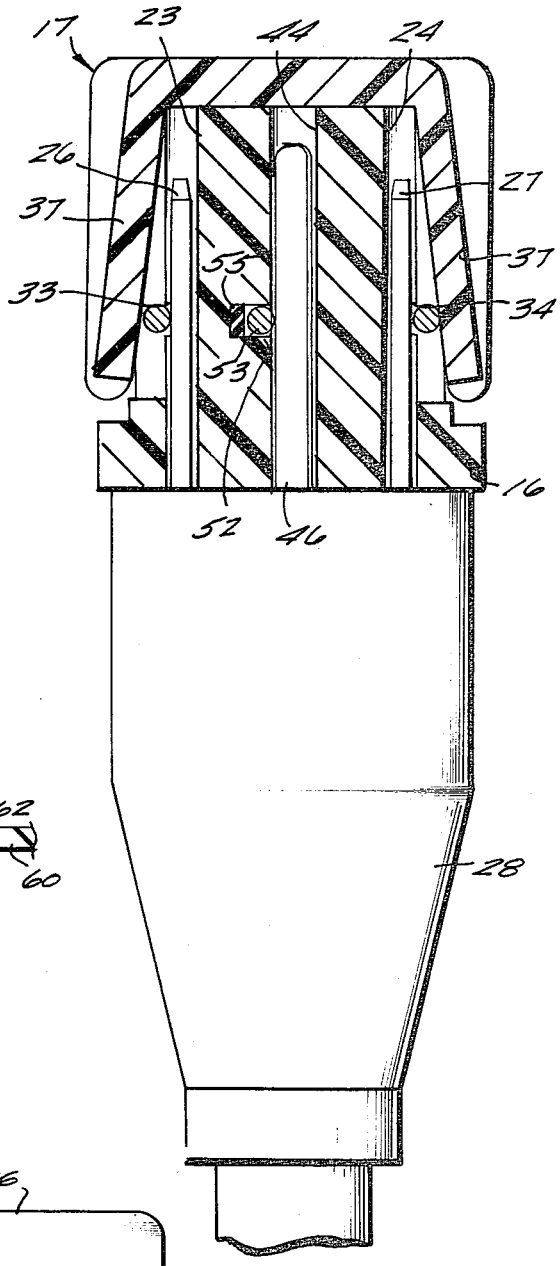
Fig. 8
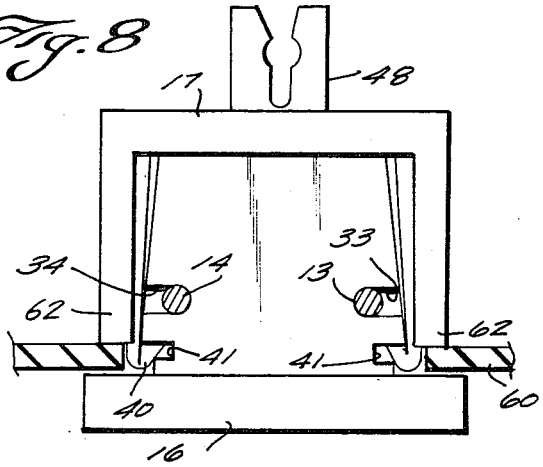
Fig. 7
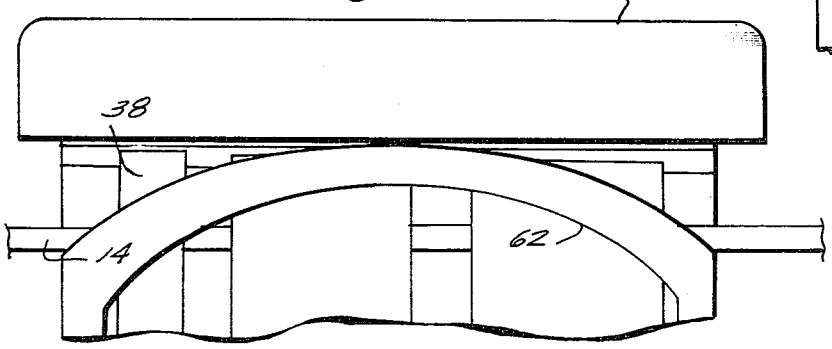

SOLDERLESS UNIVERSAL OUTLET

BACKGROUND AND SUMMARY OF THE INVENTION

Conventional electrical receptacles include receptacle bodies having electrical plug prong-receiving slots formed therein, with a conductor assembly formed in each slot. The conductor assembly, such as exemplified by U.S. Pat. Nos. 2,743,423 and 3,081,442, usually comprises a conductor wire with a spring contact engaging the conductor wire and disposed in the slot for making frictional engagement with a prong inserted into the slot. Such constructions perform their intended functions well, but are relatively expensive to make and to install in junction boxes, multiple electrical outlet strips, or the like. Because of such disadvantages, U.S. Pat. No. 4,113,334 (the disclosure of which is hereby incorporated by reference herein) has proposed the formation of the terminals from the conductors in such a way that a number of receptacles may be electrically interconnected easily together by soldering and/or crimping of the contact terminals in engagement with the current carrying wires. While such an arrangement is eminently practical it too is more expensive and time consuming than desired.

According to the present invention, an electrical receptacle is provided that eliminates all the drawbacks inherent in prior arrangements. According to the present invention an electrical receptacle is provided that has a minimum number of components and can be assembled in the simplest manner possible. The only electrical plug prong-engaging conductive components comprise the conductor wires themselves, and the wires are arranged in such a manner that no soldering or crimping is necessary to effect connection thereof. Rather the receptacle body component parts are merely snapped together to retain the wires in appropriate position, and to securely fasten the assembly to the mounting surface which could be a front plate, multiple outlet strip, or junction box, etc. Any number of receptacles can be connected in this manner with the same conductor wires. Such an arrangement provides the epitomy of simplicity, minimized costs, and minimized labor in assembling components.

According to one aspect of the present invention, an electrical receptacle is provided by a receptacle body of electrical insulating material with means defining first and second spaced, parallel, elongated prong-receiving slots in the receptacle body. First and second conductor wires are provided, each having a bare, uninsulated portion thereof and each being substantially longer than any dimension of the body. Means are formed in the receptacle body for receiving the first and second conductor wire bare portions and mounting the first conductor wire bare portion so that it intersects the first prong-receiving slot, and for mounting the second conductor wire bare portion so that it intersects the second prong-receiving slot. The conductor wires are mounted so that the first and second wire conductor bare portions will be directly engaged by an electrical plug prong when the prong is inserted into the respective first and second prong-receiving slots. Resilient biasing means (such as a portion of the receptacle body) are provided for resiliently biasing the first and second conductor wire bare portions into intersecting relationship with the first and second prong-receiving slots. The receptacle body is preferably formed in two parts, a face part having the prong-receiving slots formed therein and having grooves along the sides thereof for receiving the conductor wires, and a rear part which is generally U-shaped and is adapted to snap into engagement with the face part and cover the sides and bottom thereof. A ground conductor and prong-receiving slot also are preferably provided in the receptacle body.

According to another aspect of the present invention, an electrical receptacle is provided comprising a receptacle body of electrical insulating material and including a face part and a rear part, and conductor means. Means define first and second parallel, spaced elongated prong-receiving slots in the receptacle body face part, and the slots are open along the opposite sides of the body face part. Means define first and second grooves in the body face part sides, each of the grooves substantially perpendicular to the direction of elongation of the first and second slots, and the first groove intersecting the first slot and the second groove intersecting the second slot. The receptacle body rear part includes a resilient portion thereof, and attaching means are provided for attaching the receptacle body face and rear parts together. The conductor means provide electrical connection with an electrical prong inserted into each of the prong-receiving slots, and the conductor means consist of first and second conductor wires each having a bare portion thereof. The first wire is received by the first groove and has the bare portion thereof at the intersection of the first groove with the first slot, and the second wire is received by the second groove and has the bare portion thereof at the area of intersection of the second groove with the second slot. The attaching means attach the body parts together so that the rear part resiliently biases the first and second conductor wire bare portions into intersecting relationship with the respective prong-receiving slots.

An electrical receptacle according to the invention may be combined with a plurality of other identical electrical receptacles, with the first and second conductor wires being common to all of the plurality of receptacles.

According to another aspect of the present invention, a method of making an electrical receptacle is provided. The method steps include: Forming an electrical receptacle body face part of electrical insulating material. Forming first and second spaced, parallel, elongated prong-receiving slots in the face part. Forming first and second wire-receiving grooves in the sides of the face part, both grooves being substantially perpendicular to the direction of elongation of the prong-receiving slots, and the first groove intersecting the first slot, and the second groove intersecting the second slot. Forming an electrical receptacle body rear part of electrical insulating material, with a resilient portion thereof. And, providing conductors for making contact with an electrical plug prong inserted into the prong-receiving slots. The conductors-providing step consists of the substeps of providing first and second conductor wires, each having a bare portion thereof; placing the first conductor wire in the first groove with the bare portion thereof at the area of intersection of the first groove and the first slot; placing the second conductor wire in the second groove with the bare portion thereof at the area of intersection of the second groove and the second slot; and fixing the electrical receptacle body face and rear parts together so that the body rear part resilient portion engages the first and second conductor wire bare portions and biases them into intersecting relationship with the first and second prong-receiving slots, and covers the sides of the face part. Spring members integral with the receptacle rear part accommodate variations in thickness of the mounting surface.

It is the primary object of the present invention to provide a simple, inexpensive, electrical receptacle having the minimum number of parts and being electrically connectable without soldering or crimping of any terminal components or the like. This and other objects of the invention will become clear from an inspection of the detailed description of the invention and from the appended claims.

BRIEF DESCRIPTION OF THE DRAWINGS

FIG. 1 is a top plan view of an exemplary electrical receptacle according to the present invention;

FIG. 2 is a bottom plan view of the receptacle of FIG. 1;

FIG. 3 is an end view of the receptacle of FIG. 1;

FIG. 4 is a side view of a plurality of receptacles of FIG. 1 electrically interconnected together in a multiple electrical outlet strip or the like;

FIG. 5 is a cross-sectional view taken along lines 5—5 of FIG. 4;

FIG. 6 is a cross-sectional view of a modified form of the receptacle of FIG. 5 shown in operative relationship with an electrical plug;

FIG. 7 is a side view of a receptacle like that of FIGS. 1–3 with integral spring mounting members; and FIG. 8 is an end view of the FIG. 7 modification shown in mounting relationship with a mounting surface.

DETAILED DESCRIPTION OF THE DRAWINGS

An electrical receptacle according to the present invention is shown generally at 10 in the drawings. The three major components of the receptacle include a receptacle body 12 of electrically insulating material, a first conductor wire 13, and a second conductor wire 14. Conventional plastics having good dielectric properties with some ability to "flex" are suitable for the insulating material of body 12. For instance, Phenolic plastics, if the body 12 is formed by compression molding, are suitable, and Valox is a suitable plastic if the body 12 is formed by injection molding.

The receptacle body 12 preferably comprises two body parts, such as face part 16 and rear part 17. Means are provided defining first and second spaced parallel, elongated prong-receiving slots 23, 24 in the body 12, primarily in the face part 16 thereof. Means are formed in the receptacle body 12 for receiving the first and second conductor wires 13, 14 and mounting them so that they intersect the first and second prong-receiving slots 23, 24 respectively of plug 28 (see FIGS. 5 and 6 in particular) so that the bare portions thereof will be directly engaged by an electrical plug prong 26, 27 respectively (see FIG. 6) when received by a slot 23, 24 respectively. Such conductor wire receiving and mounting means includes the formation of the slots 23, 24 so that they are open on the sides of the body face part 16; means defining first and second grooves 33, 34 respectively in the sides of the body face part 16, the grooves 33, 34 receiving the first and second conductor wires 13, 14 respectively; and the receptacle body rear part 17. The grooves 33, 34 are formed so that they are substantially perpendicular to the direction of elongation of the prong-receiving slots 23, 24, as indicated in the drawings.

The receptacle body second part 17 includes a portion thereof that resiliently biases the conductor wires 13, 14 so that they intersect the prong-receiving slots 23, 24. As illustrated in the drawing, the rear part 17 may be generally U-shaped, and include first (36) second (37) and third (38) generally U-shaped subparts. The first and third subparts 36, 38 are relatively thick and therefore relatively inflexible (see and compare FIGS. 3 and 5), while the second part 37 is relatively thin and therefore relatively flexible and provides for the resilient biasing of the conductor wires 13, 14.

The face 16 and rear 17 parts of the receptacle body 12 may be held together in any convenient manner. One particularly suitable manner is to form a tongue and groove connection between the part 16, 17 so that when they are snapped together the tongues and grooves hold them together. For instance, with respect to FIG. 3, attention is directed to the tongue portions 40 formed on the arms of the U-shaped first and third subparts 36, 38, and the continuous grooves 41 formed along the sides of the face part 16 for receipt of the tongues 40. The tongues 40 are dimensioned and the face part 16 is sloped, so that the rear part 17 may be pushed over the face part 16 with the legs of the U-shaped first and third subparts 36, 38 being cammed outwardly until the tongues 40 fall into the grooves 41, latching the parts 16, 17 together with the second subpart 37 resiliently biasing the conductor wires 13, 14 to intersect the prong-receiving grooves 23, 24 (see FIGS. 5 and 6 in particular).

As seen in FIG. 3, the tongue portions 40 and associated arms of the receptacle body portion are elongated in a dimension parallel to the dimension of elongation of said prong-receiving slots 23, 24. Each tongue portion 40 includes a cam surface 42, and a locking surface 43 extending substantially perpendicular to the dimension of elongation of said tongue and arm portion 40, and adjacent said cam portion 42.

While the receptacles 10 are illustrated in the drawings with only one set of prong-receiving openings 23, 24 etc., the parts 16, 17 may be much elongated to contain 2, 3, 4 or any number of prong- receiving openings 23, 24 and associated structures. The conductors 13, 14 extend in line with the various portions of the receptacles.

The conductor wires 13, 14 are illustrated in the drawings as completely bare, however if desirable only portions thereof at the area of intersection of the grooves 33, 34 and the prong-receiving slots 23, 24 need be bare.

The electrical receptacle 10 according to the present invention also preferably includes a ground contactor. A third elongated prong-receiving slot 44 is provided in the body part 16 for a conventional ground prong 46 (see FIG. 6) of a conventional electrical plug 28 and a conductor is received by the receptacle body for contacting the electrical plug ground prong when inserted into the prong-receiving slot 44. The electrical conductor can be a conventional electrical conductor having a terminal 48, such as provided in U.S. Pat. No. 4,113,334 (the disclosure of which is hereby incorporated by reference herein), in which case an opening 50 is formed in the rear body part 17 for passage of the terminal 48 therethrough. Such an arrangement is illustrated in FIGS. 2–5. Alternatively, the ground conductor arrangement could be similar to the neutral and hot conductor wire 13, 14 arrangements described above. That is, with reference to FIG. 6, an interior passageway 52 may be provided in the body face part 16 for receipt of a grounding conductor wire 53 which intersects the ground prong-receiving slot 44. A resilient material pad 55 could be provided in the passageway 52, if desired, to bias the wire 53 into the intersecting relationship with the slot 44, as illustrated in FIG. 6.

The receptacles 10 according to the present invention may be readily connected together in a multiple electrical outlet strip or the like. For instance, as illustrated in FIG. 4, a plurality of the receptacles 10 can be inserted so that the face part 16 of the receptacle body 12 is each received by and faces outwardly of a housing face 60 (such as the casing component illustrated in U.S. Pat. No. 4,113,334), being held therein in any suitable manner, such as shown in U.S. Pat. No. 4,113,334, or as shown in FIGS. 7 and 8. Electrical interconnection of the components is simply provided by disposing the conductor wires 13, 14 in the grooves 33, 34 formed in each of the receptacles 10, respectively, and then snapping the rear receptacle body parts 17 into interengagement with the receptacle body first parts 16 so that the resilient portion 37 of each receptacle body biases the conductors 13, 14 into intersecting relationship with the prong-receiving slots 23, 24 of that receptacle. The common ground wire 53 is merely laid in the ground terminals 48 of the receptacles 10, being snapped into place therein.

In the embodiment illustrated in FIGS. 7 and 8, connection of each receptacle to the housing face 60 is accomplished utilizing the spring members 62. These plastic springs 62 are molded integrally with the rear part 17 of the receptacle 10, and provide ready mounting of the receptacles 10 to face plates (mounting surfaces) 60 of varying thickness.

CONSTRUCTION AND OPERATION

An electrical receptacle according to the present invention is formed by forming the body face part 16 of electrical insulating material, and the receptacle body rear part 17 of electrical insulating material, with a resilient portion 37 thereof. First and second spaced, parallel, elongated prong-receiving slots 23, 24 are formed in the face part 16, and first and second wire-receiving grooves 33, 34 are formed in the sides thereof. Conductors for making contact with an electrical plug prong 26, 27 inserted into the prong-receiving slots 23, 24 are provided by practicing the substeps consisting of: providing first and second bare conductor wires 13, 14; placing the conductor wires 13, 14 in the first and second grooves 33, 34 respectively; and affixing the receptacle body 12, face 16 and rear 17 parts together by moving them toward each other unitl the tongue 40 and groove 41 components thereof snap together, with the resilient portion 37 biasing the conductors 13, 14 into intersecting relationship with the slots 23, 24 and with the sides of the face part 16 covered by the rear part 17. The ground terminal 48 passes through passageway 50 in the rear part 17, and a suitable ground wire 53 is laid in the terminal 48. Any number of receptacles 10 can be assembled into a multiple electrical outlet strip or the like, as disclosed in U.S. Pat. No. 4,113,334.

It will thus be seen that according to the present invention an electrical receptacle has been provided (and method for making same) which is simple, inexpensive, and readily connectable with other receptacles, and effective. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and methods.

What is claimed is:

1. An electrical receptacle comprising:

a receptacle body of electrical insulating material, and including a face part and a rear part;

means defining first and second parallel, spaced, elongated prong-receiving slots in said receptacle body face part, said slots open along the opposite sides of said body face part;

means defining first and second grooves in said body face part sides, each of said grooves substantially perpendicular to the direction of elongation of said first and second slots, and said first groove intersecting said first slot, and said second groove intersecting said second slot;

conductor means for providing electrical connection with an electrical plug prong inserted into each of said prong-receiving slots, said conductor means consisting of first and second conductor wires, each having a bare portion thereof at the area of intersection of said first groove with said first slot; and said second wire received by said second groove and having said bare portion thereof at the area of intersection of said second groove with said second slot;

said receptacle body rear part including a resilient portion thereof engaging said first and second conductor wire bare portions and resiliently biasing them into intersecting relationship with said respective prong-receiving slots; and attaching means for attaching said receptacle body face and rear parts together with said rear part resilient portion engaging and biasing said conductor wire bare portions.

2. An electrical receptacle as recited in claim 1 further comprising means defining a third elongated prong-receiving slot in said receptacle body for receipt of an electrical plug ground prong, and a conductor received by said receptacle body for contacting an electrical plug ground prong when inserted in said prong-receiving slot.

3. An electrical receptacle as recited in claim 1 in combination with a plurality of other identical electrical receptacles, said first and second conductor wires being common to all said plurality of receptacles.

4. A method of making an electrical receptacle comprising the steps of:

forming an electrical receptacle body face part of electrical insulating material;

forming first and second spaced, parallel, elongated prong-receiving slots in said face part;

forming first and second wire-receiving grooves in the sides of said face part, both grooves being substantially perpendicular to the direction of elongation of the prong-receiving slots, and the first groove intersecting the first slot and the second groove intersecting the second slot;

forming an electrical receptacle body rear part of electrical insulating material, with a resilient portion thereof; and providing conductors for making contact with an electrical plug prong inserted into the prong-receiving slots, said conductors-providing step consisting of the substeps of providing first and second conductor wires, each having a bare portion thereof; placing the first conductor wire in the first groove with the bare portion thereof at the area of intersection of the first groove and the first slot; placing the second conductor wire in the second groove with the bare portion thereof at the intersection of the second groove and the second slot; and affixing the electrical receptacle body face and rear part together so that the body rear part resilient portion engages the first and second conductor wire bare portions and biases them to intersecting relationship with the first and second prong-receiving slots, and covers the sides of the face part.

5. A method as recited in claim 4 comprising the further step of connecting the electrical receptacle with a plurality of other identical receptacles by interconnecting the first and second conductor wires between them all.

6. A method as recited in claim 4 comprising the further step of disposing said face part so that enlarged portions thereof engage a mounting structure on one side of the mounting structure; and simultaneously with said affixing of the receptacle body and face parts together, mounting the receptacle to the mounting surface by bringing a spring member integral therewith into engagement with the mounting surface on the other side of the mounting surface from the face part enlarged portions.

7. An electrical receptable comprising: a receptacle body of electrical insulating material; means defining first and second spaced, parallel, elongated prong-receiving slots in said receptacle body; first and second conductor wires, each having a bare, uninsulated portion thereof, and each being substantially longer than any dimensions of said body; means formed in said receptacle body for receiving said first and second conductor wire bare portions and mounting said first conductor wire bare portion so that it intersects said first prong-receiving slot at an intermediate portion of said slot, and for mounting said second conductor wire bare portion so that it intersects said second prong-receiving slot at an intermediate portion of said slot, and mounting said conductor wires so that said first and second wire conductor bare portions will be directly tangetially engaged by an electrical plug prong when a said prong is inserted into said respective first and second prong-receiving slots; resilient biasing means for resiliently biasing said first and second conductor wire bare portions into intersecting relationship with said first and second prong-receiving slots, including a portion of said receptacle body; and wherein said receptacle body comprises two parts: a face part having the entrances for said means defining said prong-receiving slots formed therein, and having open side portions providing said prong-receiving slots each open along one side thereof; and a rear part for receiving said face part and covering the sides thereof, said rear part including a pair of side portions thereof formed as said resilient biasing means, and wherein said rear part is generally U-shaped, and comprises first, second, and third subparts, each of said subparts also being generally U-shaped; said first and third subparts being relatively thick and therefore relatively inflexible, and said second subpart being located between said first and third subparts and being relatively thin and therefore relatively flexible, said second subpart forming said resilient biasing means; and cooperating tongue-and-groove surface manifestations formed on said rear part first and third subparts, and said face part sides, for cooperation to releasbly hold said face and rear parts together when brought into interengagement.

8. An electrical receptacle comprising: a receptacle body of electrical insulating material; means defining first and second spaced, parallel, elongated prong-receiving slots in said receptacle body; first and second conductor wires, each having a bare, uninsulated portion thereof, and each being substantially longer than any dimensions of said body; means formed in said receptacle body for receptacle body for receiving first and second conductor wire bare portions and mounting said first conductor wire bare portion so that it intersects said first prong-receiving slot at an intermediate portion of said slot, and for mounting said second conductor wire bare portion so that it intersects said second prong-receiving slot at an intermediate portion of said slot, and mounting said conductor wires so that said first and second wire conductor bare portions will be directly tangentially engaged by an electrical plug prong when a said prong is inserted into said respective first and second prong-receiving slots; resilient biasing means, including a portion of said receptacle body, for resiliently biasing said first and second conductor wire bare portions into intersecting relationship with said first and second prong-receiving slots; and wherein said receptacle body comprises two parts: a face part having the entrances for said means defining said prong-receiving slots formed therein, and having open side portions providing said prong-receiving slots each open along one side thereof; and a rear part for receiving said face part and covering the sides thereof, said rear part including a pair of side portions thereof formed as said resilient biasing means; and wherein said means formed in said receptacle body for receiving said first and second conductor wire bare portions further comprise means defining an open groove in said receptacle body face part along each side thereof, each groove for receipt of one of said first and second conductor wires, and said grooves extending substantially perpendicular to said prong-receiving slots.

9. An electrical receptacle as recited in claim 7 or 8 wherein said conductor wire receiving and mounting means comprise means for mounting said wires so that they extend substantially perpendicular to the direction of elongation of said prong-receiving slots.

10. An electrical receptacle as recited in claim 7 or 8 further comprising means defining a third elongated prong-receiving slot in said receptacle body for receipt of an electrical plug ground prong, and a conductor received by said receptacle body for contacting an electrical plug ground prong when inserted in said prong-receiving slot.

11. An electrical receptacle as recited in claim 7 or 8 further comprising at least one spring member integral with said rear part, and cooperating with a portion of said face part to mount the receptacle to a mounting structure.

* * * * *